US005422001A

United States Patent [19]

Yagoda et al.

[11] Patent Number: 5,422,001

[45] Date of Patent: Jun. 6, 1995

[54] ENLARGED POOL SKIMMER WITH A BUOYANCY COMPONENT

[76] Inventors: Gordon B. Yagoda, 12903 Beech Daly, Redford, Mich. 48239; Robert T. Trzeciak, 1729 Rose, Lincoln Park, Mich. 48146

[21] Appl. No.: 237,844

[22] Filed: May 4, 1994

[51] Int. Cl.[6] ..... E04H 3/16

[52] U.S. Cl. ..... 210/169; 210/238; 210/470; 210/242.1; 15/1.7; 4/490; 4/496; 43/11

[58] Field of Search ..... 210/169, 237, 238, 416.2, 210/470, 499, 242.1, 242.2, 242.3, 923; 15/1.7; 4/490, 496; 43/11, 14

[56] References Cited

U.S. PATENT DOCUMENTS

| | | | |
|---|---|---|---|
| 2,367,997 | 1/1945 | Chambers | 4/490 |
| 3,699,700 | 10/1972 | Kinsell | 43/14 |
| 4,053,412 | 10/1977 | Stix | 210/169 |
| 4,369,109 | 1/1983 | Edge | 210/169 |
| 4,426,286 | 1/1984 | Puckett et al. | 210/169 |
| 4,518,495 | 5/1985 | Harding | 210/169 |
| 4,746,424 | 5/1988 | Drew | 210/169 |
| 4,822,487 | 4/1989 | Soich | 210/238 |
| 4,846,972 | 7/1989 | Anderson | 210/238 |
| 4,888,842 | 12/1989 | McKamey et al. | 15/1.7 |
| 4,994,178 | 2/1991 | Brooks | 15/1.7 |
| 5,043,060 | 8/1991 | Brennan | 210/169 |
| 5,139,660 | 8/1992 | Lourie et al. | 210/169 |
| 5,167,805 | 12/1992 | Theiss | 210/169 |
| 5,173,181 | 12/1992 | Mc Farland | 210/169 |
| 5,223,135 | 6/1993 | MacPhee et al. | 210/416.2 |
| 5,277,801 | 1/1994 | Lundquist | 210/169 |
| 5,279,728 | 1/1994 | Weiss | 210/169 |

*Primary Examiner*—Robert A. Dawson
*Assistant Examiner*—Robert James Popovics

[57] ABSTRACT

An enlarged pool skimmer with a buoyancy component including a frame. The frame is formed of an upper horizontal tube in an inverted U-shaped configuration with downwardly extending ends and a lower angled tube in a U-shaped configuration with upwardly extending ends and with vertically extending brackets coupling the ends of the tubes at an outboard side and an inboard side. The brackets are formed with longitudinal slots extending vertically over the majority of the central extent of the brackets. A cylindrical pipe is positionable in a horizontal orientation with supports at the opposite ends thereof for adjustably coupling the ends of the pipe to the slots of the brackets. Also included are bolts and associated nuts which extend through the brackets at the ends of the pipe to allow for vertical adjustment of the pipe with respect to the frame. A fine mesh screen is formed of a plastic material covering the space between the upper tube, the lower tube and the side brackets.

5 Claims, 3 Drawing Sheets

FIG. 1
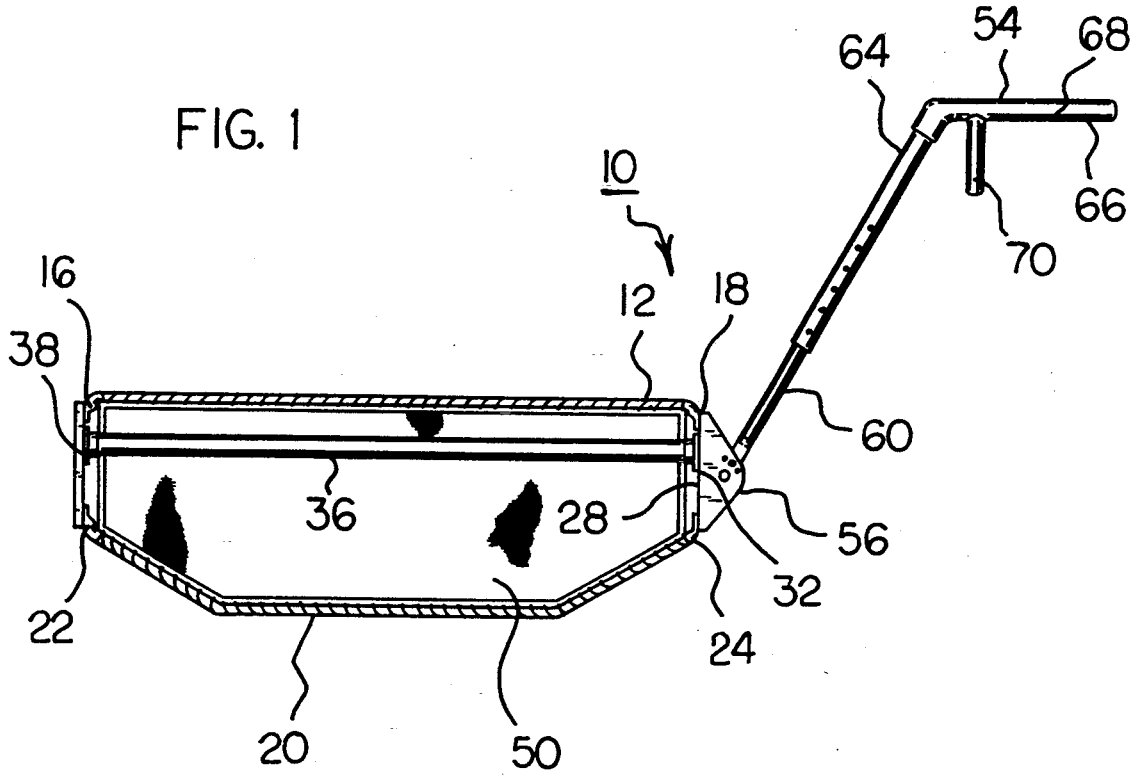
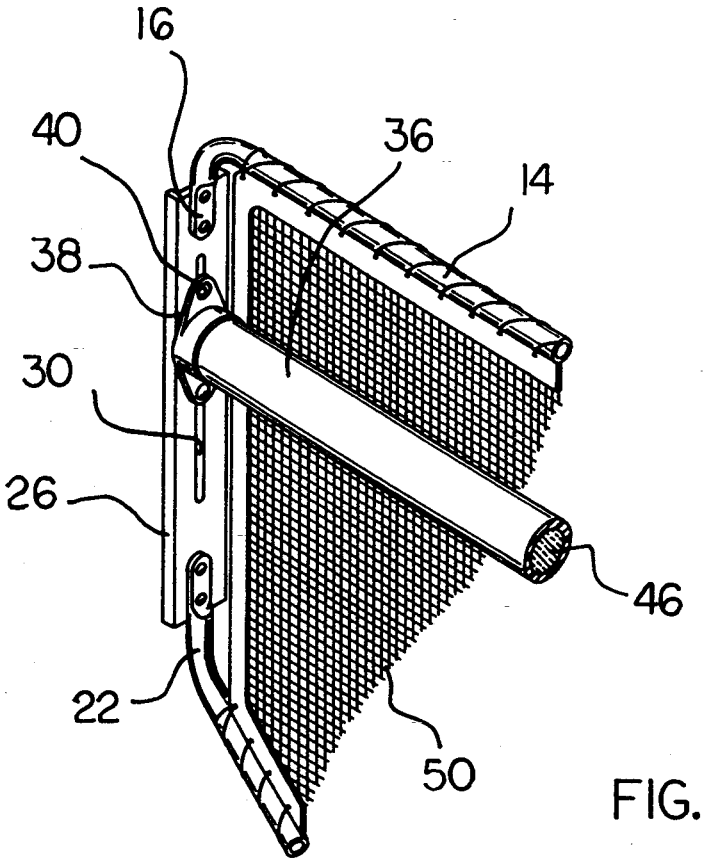
FIG. 2

ENLARGED POOL SKIMMER WITH A BUOYANCY COMPONENT

BACKGROUND OF THE INVENTION

1. Field of the Invention

The present invention relates to an enlarged pool skimmer with a buoyancy component and more particularly pertains to skimming pools with an enlarged screen and with a component for providing buoyancy to facilitate handling.

2. Description of the Prior Art

The use of pool skimmers of various sizes and shapes is known in the prior art. More specifically, pool skimmers of various sizes and shapes heretofore devised and utilized for the purpose of skimming pools to remove debris are known to consist basically of familiar, expected, and obvious structural configurations, notwithstanding the myriad of designs encompassed by the crowded prior art which has been developed for the fulfillment of countless objectives and requirements.

By way of example, the prior art discloses in U.S. Pat. No. 5,043,060 to Brennan discloses a swimming pool skimmer.

U.S. Pat. No. 4,822,487 to Soich discloses a pool skimmer.

U.S. Pat. No. 4,746,424 to Drew discloses a floating swimming pool skimmer.

U.S. Pat. No. 4,518,495 to Harding discloses a pool skimmer.

U.S. Pat. No. 4,426,286 to Puckett discloses a skimmer.

In this respect, the enlarged pool skimmer with a buoyancy component according to the present invention substantially departs from the conventional concepts and designs of the prior art, and in doing so provides an apparatus primarily developed for the purpose of skimming pools with an enlarged screen and with a component for providing buoyancy to facilitate handling.

Therefore, it can be appreciated that there exists a continuing need for new and improved enlarged pool skimmer with a buoyancy component which can be used for skimming pools with an enlarged screen and with a component for providing buoyancy to facilitate handling. In this regard, the present invention substantially fulfills this need.

SUMMARY OF THE INVENTION

In view of the foregoing disadvantages inherent in the known types of pool skimmers of various sizes and shapes now present in the prior art, the present invention provides an improved enlarged pool skimmer with a buoyancy component. As such, the general purpose of the present invention, which will be described subsequently in greater detail, is to provide a new and improved enlarged pool skimmer with a buoyancy component and method which has all the advantages of the prior art and none of the disadvantages.

To attain this, the present invention essentially comprises an enlarged pool skimmer with a buoyancy component comprising, in combination: a frame, the frame being formed of an upper horizontal tube in an inverted U-shaped configuration with downwardly extending ends and a lower angled tube in a U-shaped configuration with upwardly extending ends and with vertically extending brackets coupling the ends of the tubes at an outboard side and an inboard side, the brackets being formed with longitudinal slots extending vertically over the majority of the central extent of the brackets; a cylindrical pipe positionable in a horizontal orientation with supports at the opposite ends thereof for adjustably coupling the ends of the pipe to the slots of the brackets, and also including bolts and associated nuts extending through the brackets at the ends of the pipe to allow for vertical adjustment of the pipe with respect to the frame; a fine mesh screen formed of a plastic material covering the space between the upper tube, the lower tube and the side brackets; and a handle assembly including triangular plates secured to the inboard end of the frame with a central aperture slot therethrough and a plurality of adjustment apertures spaced a predetermined distance from the central aperture, and with a rod having a lower end pivotally coupled to the central aperture and an upper end formed as a handle with a horizontal portion and a downwardly extending trigger for the user, the lower end constituting an internal cylindrical component and the upper end constituting an external cylindrical component with a resilient adjustment pin extending through apertures in the upper and lower ends for varying the length of the handle, and a quick release pin removably positionable through the lower end of the handle adjacent to the central aperture for coupling with a predetermined adjustment hole for varying the angle of the handle with respect to the frame.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide new and improved enlarged pool skimmer with a buoyancy component which have all the advantages of the prior art pool skimmers of various sizes and shapes and none of the disadvantages.

It is another object of the present invention to provide new and improved enlarged pool skimmer with a buoyancy component which may be easily and efficiently manufactured and marketed.

It is further object of the present invention to provide new and improved enlarged pool skimmer with a buoyancy component which are of durable and reliable constructions.

An even further object of the present invention is to provide new and improved enlarged pool skimmer with a buoyancy component which are susceptible of a low cost of manufacture with regard to both materials and labor, and which accordingly are then susceptible of low prices of sale to the consuming public, thereby making such enlarged pool skimmer with a buoyancy component economically available to the buying public.

Still yet another object of the present invention is to provide new and improved enlarged pool skimmer with a buoyancy component which provide in the apparatuses and methods of the prior art some of the advantages thereof, while simultaneously overcoming some of the disadvantages normally associated therewith.

Still another object of the present invention is to skimming pools with an enlarged screen and with a component for providing buoyancy to facilitate handling.

Lastly, it is an object of the present invention to provide new and improved enlarged pool skimmer with a buoyancy component a frame, the frame being formed of an upper horizontal tube in an inverted U-shaped configuration with downwardly extending ends and a lower angled tube in a U-shaped configuration with upwardly extending ends and with vertically extending brackets coupling the ends of the tubes at an outboard side and an inboard side, the brackets being formed with longitudinal slots extending vertically over the majority of the central extent of the brackets; a cylindrical pipe positionable in a horizontal orientation with supports at the opposite ends thereof for adjustably coupling the ends of the pipe to the slots of the brackets, and also including bolts and associated nuts extending through the brackets at the ends of the pipe to allow for vertical adjustment of the pipe with respect to the frame; a fine mesh screen formed of a plastic material covering the space between the upper tube, the lower tube and the side brackets.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a front sectional view of the new and improved enlarged pool skimmer with a buoyancy component constructed in accordance with the principles of the present invention.

FIG. 2 is a perspective illustration of a portion of one side of the device shown in FIG. 1.

The same reference numerals refer to the same parts through the various Figures.

DESCRIPTION OF THE PREFERRED EMBODIMENT

Figure 3:
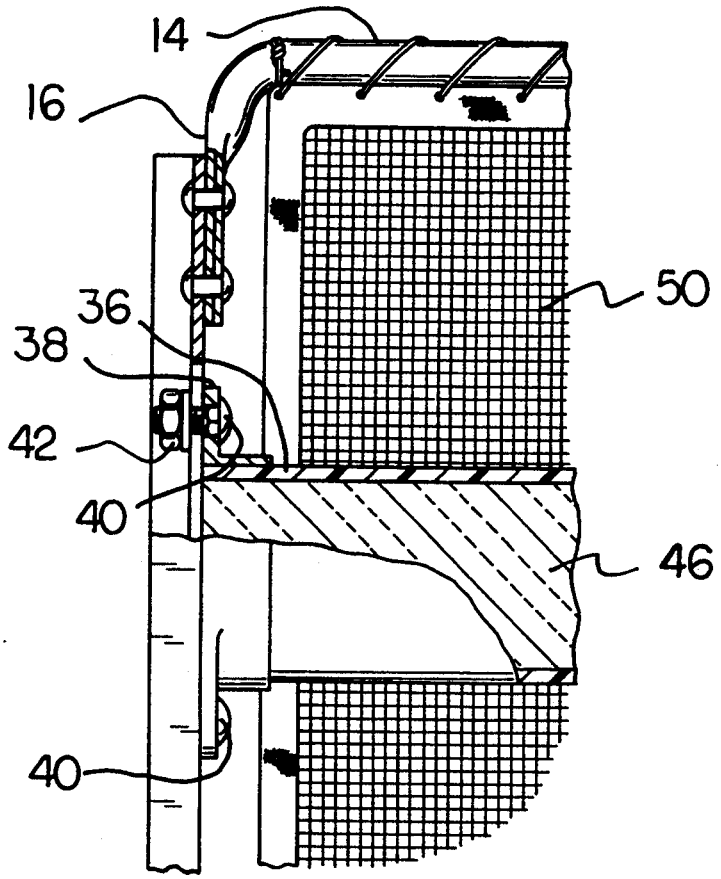
FIG. 3 is a front elevational view partly in section of the end of the device shown in FIG. 2.
Figure 4:
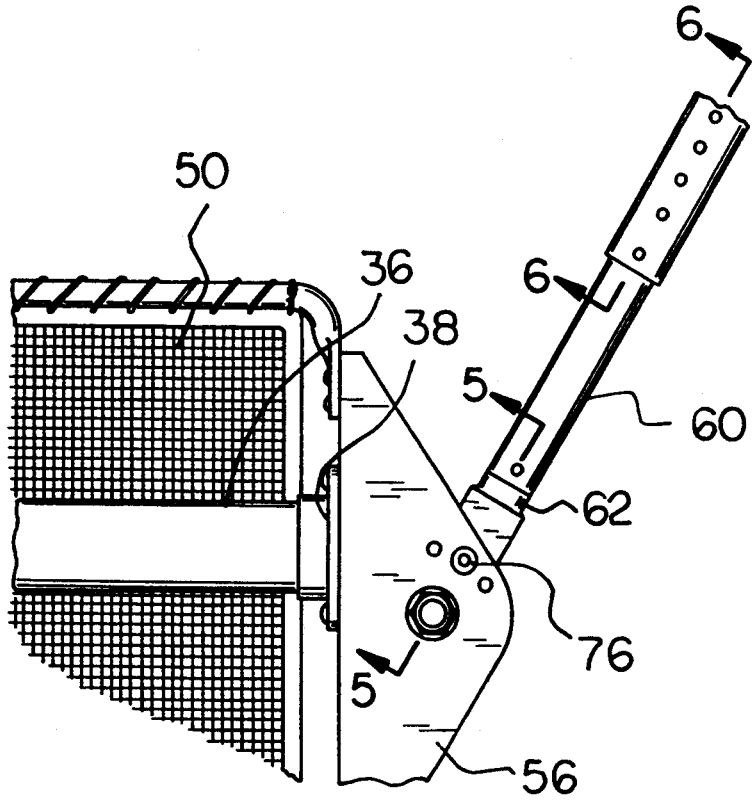
FIG. 4 is a front elevational view of the opposite side of the device shown in FIGS. 2 and 3.
Figure 5:
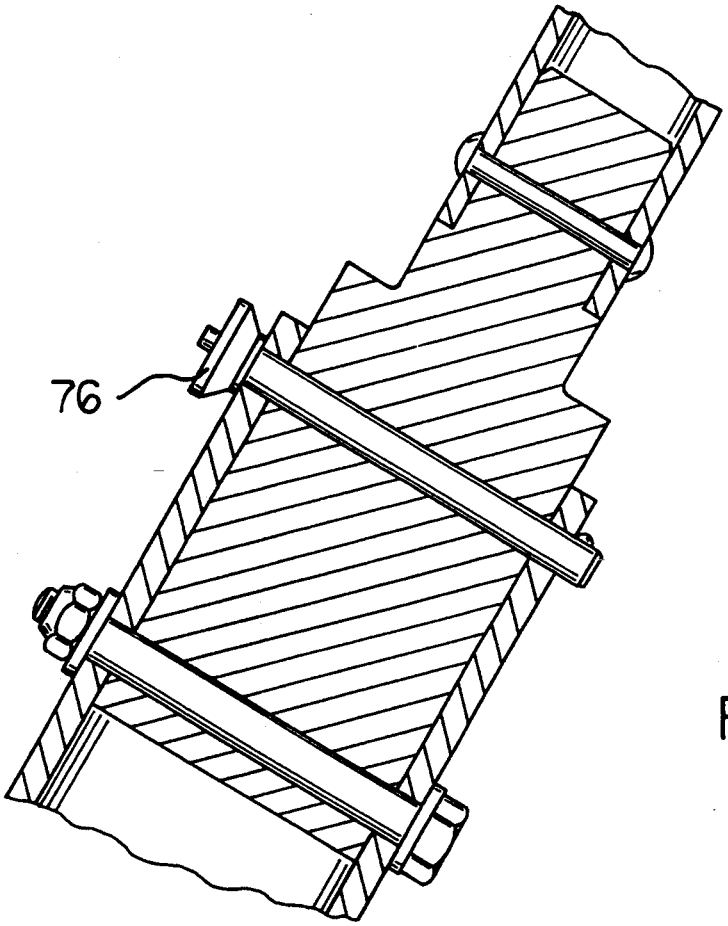
FIG. 5 is a cross sectional view of the lower portion of the handle taken along line 5—5 of FIG. 4.
Figure 6:
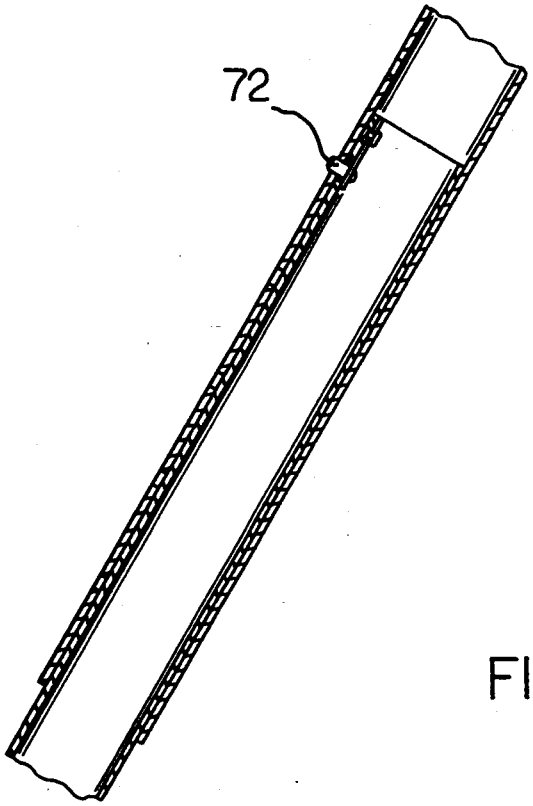
FIG. 6 is a cross sectional view of the intermediate portion of the handle taken along line 6—6 of FIG. 4.

With reference now to the drawings, and in particular to FIG. 1 thereof, the preferred embodiment of the new and improved enlarged pool skimmer with a buoyancy component embodying the principles and concepts of the present invention and generally designated by the reference numeral 10 will be described.

The present invention, the new and improved enlarged pool skimmer with a buoyancy component is comprised of a plurality of components. Such components include a frame, a cylindrical pipe, a screen, and a handle. Such components are individually configured and correlated with respect to each other so as to attain the desired objectives.

More specifically, the system 10 of the present invention includes a frame 12. The frame is formed of an upper horizontal tube 14 in an inverted U-shaped configuration. The tube includes downwardly extending legs 16 and 18. The frame also includes a lower angled tube 20 in a U-shaped configuration with upwardly extending ends 22 and 24. Also included as part of the frame for coupling the two tubes are a pair of vertically extending brackets 26 and 28. The brackets couple the ends of the tubes at an outboard side and an inboard side. The brackets are formed with longitudinal slots 30 and 32 extending vertically over the majority of the central extent of the brackets.

The next component of the system 10 is a cylindrical pipe 36. Such pipe is positioned in a horizontal orientation. It has supports 38 at the opposite ends of the pipe. Such supports are for adjustably coupling the ends of the pipe to the slots of the brackets. The cylindrical pipe and supports also includes bolts 40 and associated nuts 42 extending therethrough and through the brackets at the ends of the pipe. This is to allow for vertical adjustment of the pipe with respect to the frame.

In the preferred embodiment, the cylindrical pipe has a circular cross-section and is fabricated of a light weight material. Polyvinyl chloride, PVC, is preferred to increase its buoyancy, the pipe is preferably filled with a core of a foam plastic material 46.

Skimming of the water if effected through a screen 50. The screen is preferably of a fine mesh and fabricated of a plastic material. Such screen covers the space between the upper tube and the lower tube and the side brackets.

The last component of the system 10 is a handle assembly 54. The handle assembly includes triangular plates 56 secured to the inboard end of the frame. A central aperture extends through the plates. A plurality of adjustment apertures are also provided through the plates and are spaced a predetermined distance from the central aperture.

In association with the triangular plates 56 is a rod 60. The rod has a lower end 62 coupled at its lower end through a pivoting connection to the central aperture. The rod also has an upper end 64 formed as a handle 66. The handle has a horizontal portion 68 and a downwardly extending trigger 70 for being grasped by a user in a most convenient manner. The lower end of the rod constitutes an internal cylindrical component while the upper end constitutes an external cylindrical component. A resilient adjusting pin 72 is secured with respect to the interior of the internal component and extends through apertures in the upper and lower ends. Such a relationship is for varying the length of the handle.

Also as part of the handle assembly is a quick release pin 76. Such quick release pin is removably positionable through the lower end of the handle adjacent to the central aperture for coupling with a predetermined adjustment aperture for varying the angle of the handle with respect to the frame.

The particular arrangement of parts and selection of materials if for a light weight device capable of skimming pools quickly and efficiently. The overall lateral extent of the frame as defined by the length of the cylindrical pipe is of a length greater than the length of the handle. As such, it can be seen that greater efficiencies in skimming pools are possible than prior art structures.

The present invention can clean the surface of a 12'×24' swimming pool in three minutes by simply guiding it across the pool on both sides and lifting it out and shaking. Space age light material and float make it easy to maneuver and handle. A small standard hand skimmer can take over an hour to clean a soiled pool. This was invented out of necessity.

In an area with numerous trees the problem arises of millions of seeds and leaves floating through the air and into an outdoor pool. Even a normal filtering system cannot keep up with the constant deluge of seeds and consequently, is clogged up daily. To unclog you have to clean screens, empty baskets, backwash the filter, vacuum the bottom and skim the surface with a small hand skimmer. This takes all the fun out of having a pool.

We designed a skimmer to cover a much larger area, whereby one trip around the pool, approximately 3–4 minutes, and the entire surface is swept clean. The float assist device makes the present invention user friendly and the time savings allow you to use your pool, not just clean it.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved enlarged pool skimmer with a buoyancy component comprising, in combination:

a frame, the frame being formed of an upper horizontal tube in an inverted U-shaped configuration with downwardly extending ends and a lower angled tube in a U-shaped configuration with upwardly extending ends and with vertically extending brackets coupling the ends of the tubes at an outboard side and an inboard side, the brackets being formed with longitudinal slots extending vertically over the majority of the central extent of the brackets;

a cylindrical pipe positionable in a horizontal orientation with supports at the opposite ends thereof for adjustably coupling the ends of the pipe to the slots of the brackets, and also including bolts and associated nuts extending through the brackets at the ends of the pipe to allow for vertical adjustment of the pipe with respect to the frame;

a fine mesh screen formed of a plastic material covering the space between the upper tube, the lower tube and the side brackets; and a handle assembly including triangular plates secured to the inboard end of the frame with a central aperture slot therethrough and a plurality of adjustment apertures spaced a predetermined distance from the central aperture, and with a rod having a lower end pivotally coupled to the central aperture and an upper end formed as a handle with a horizontal portion and a downwardly extending trigger for the user, the lower end constituting an internal cylindrical component and the upper end constituting an external cylindrical component with a resilient adjustment pin extending through apertures in the upper and lower ends for varying the length of the handle, and a quick release pin removably positionable through the lower end of the handle adjacent to the central aperture for coupling with a predetermined adjustment hole for varying the angle of the handle with respect to the frame.

2. An enlarged pool skimmer with a buoyancy component including:

a frame, the frame being formed of an upper horizontal tube in an inverted U-shaped configuration with downwardly extending ends and a lower angled tube in a U-shaped configuration with upwardly extending ends and vertically extending brackets coupling the ends of the tubes at an outboard side and an inboard side, the brackets being formed with longitudinal slots extending vertically over the majority of the central extent of the brackets;

a cylindrical pipe positionable in a horizontal orientation with supports at the opposite ends thereof for adjustably coupling the ends of the pipe to the slots of the brackets, and also including bolts and associated nuts extending through the brackets at the ends of the pipe to allow for vertical adjustment of the pipe with respect to the frame;

a fine mesh screen formed of a plastic material covering the space between the upper tube, the lower tube and side brackets; and a handle assembly secured to the frame.

3. The device as set forth in claim 2 and further including:

a foam core located within the cylindrical pipe.

4. The device as set forth in claim 2 wherein the cylindrically pipe has a length which is greater than the length of the handle.

5. The device as set forth in claim 2 wherein the cylindrical pipe has a length which is shorter than the length of the handle with respect to the size of the frame.

* * * * *